US008058574B2

(12) United States Patent
Graf et al.

(10) Patent No.: US 8,058,574 B2
(45) Date of Patent: Nov. 15, 2011

(54) AUXILIARY CONTACT BLOCK FOR EXPANDING A SWITCHING DEVICE

(75) Inventors: Josef Graf, Hahnbach (DE); Ludwig Niebler, Laaber (DE); Johannes Voit, Weiden (DE)

(73) Assignee: Siemens Aktiengesellschaft, Munich (DE)

( * ) Notice: Subject to any disclaimer, the term of this patent is extended or adjusted under 35 U.S.C. 154(b) by 423 days.

(21) Appl. No.: 12/310,628

(22) PCT Filed: Aug. 16, 2007

(86) PCT No.: PCT/EP2007/058532

§ 371 (c)(1),
(2), (4) Date: Mar. 2, 2009

(87) PCT Pub. No.: WO2008/028785

PCT Pub. Date: Mar. 13, 2008

(65) Prior Publication Data

US 2010/0140067 A1 Jun. 10, 2010

(30) Foreign Application Priority Data

Sep. 4, 2006 (DE) ..... 10 2006 041 451

(51) Int. Cl.
*H01H 3/20* (2006.01)
*H01H 13/02* (2006.01)

(52) U.S. Cl. ..... 200/16 A; 200/243; 200/303; 200/307; 200/330; 335/132; 335/202

(58) Field of Classification Search ..... 200/16 R–16 D, 200/400, 401, 530–535, 239, 243, 245–247, 200/303, 307, 330; 335/128, 120, 131, 132, 335/202

See application file for complete search history.

(56) References Cited

U.S. PATENT DOCUMENTS 2,562,420 A * 7/1951 Furnas ..... 200/16 A
3,142,187 A * 7/1964 Kane et al. ..... 74/107
(Continued)

FOREIGN PATENT DOCUMENTS

CN 2755769 2/2006
DE 875 681 5/1953
DE 22 19 428 C2 11/1972
(Continued)

OTHER PUBLICATIONS

Office Action for Chinese patent application No. 200780031198.8 dated Jan. 26, 2011.

*Primary Examiner* — Michael Friedhofer
(74) *Attorney, Agent, or Firm* — Harness, Dickey & Pierce, P.L.C.

(57) ABSTRACT

An auxiliary contact block is disclosed for expanding a switching device and to a switching device having at least one auxiliary contact block. A compact auxiliary contact block, i.e. a block requiring little wiring and space, for a switching device is disclosed, and a switching device having at least one auxiliary contact block. In at least one embodiment of the auxiliary contact block, the auxiliary contact block includes auxiliary contacts disposed in a plane, the contacts having contact bridges and associated fixed contact pieces, and at least one contact slider, which can be equipped with at least one auxiliary contact pair. The configuration of the auxiliary contacts in a plane as described herein allows a very small installation size and very little wiring complexity of the auxiliary contacts in a simple manner. The actuating unit can, for example, be configured as a slider that couples the contact slider and the switching device with each other.

19 Claims, 2 Drawing Sheets

U.S. PATENT DOCUMENTS

| | | | | | |
|---|---|---|---|---|---|
| 3,436,497 | A | * | 4/1969 | Mading | 200/16 A |
| 3,586,795 | A | * | 6/1971 | Mentel et al. | 200/243 |
| 4,277,662 | A | * | 7/1981 | Lewandowski | 200/242 |
| 4,616,117 | A | * | 10/1986 | Kleine | 200/243 |
| 5,145,057 | A | * | 9/1992 | Hirota et al. | 200/243 |
| 5,369,237 | A | * | 11/1994 | Mejerl et al. | 200/524 |
| 6,441,328 | B1 | * | 8/2002 | Matejka et al. | 200/330 |
| 6,822,173 | B1 | * | 11/2004 | Schafer | 200/16 A |

FOREIGN PATENT DOCUMENTS

| | | |
|---|---|---|
| DE | 196 36 109 | 12/1997 |
| DE | 697 01 149 | 6/2000 |
| DE | 101 18 919 | 10/2002 |
| DE | 102 96 272 T5 | 4/2004 |
| DE | 10 2004 034 859 | 2/2006 |
| WO | WO 2005/101444 | 10/2005 |

* cited by examiner

AUXILIARY CONTACT BLOCK FOR EXPANDING A SWITCHING DEVICE

PRIORITY STATEMENT

This application is the national phase under 35 U.S.C. §371 of PCT International Application No. PCT/EP2007/058532 which has an International filing date of Aug. 16, 2007, which designated the United States of America and which claims priority on German application No. 10 2006 041 451.9 filed Sep. 4, 2006, the entire contents of each of which are hereby incorporated herein by reference.

FIELD

At least one embodiment of the he invention generally relates to an auxiliary contact block for expanding a switching device and/or a switching device with at least one inventive auxiliary contact block.

A switching device within the meaning of embodiments of the invention here is an electromechanical switching device or switching device combinations with electronic overload protection, such as for example electronic power circuit breakers, miniature circuit breakers or contactors in combination with an electronic overload relay, with one or more conducting paths and with one or more switching points (typically per conducting path).

BACKGROUND

Generally switching devices can be expanded with one or more auxiliary contact blocks, which can be built onto the switching device on a housing or housing part or are already integrated in the device. The auxiliary contacts here serve for a specific function, for example to communicate the status of the main contact poles. In the case of power circuit breakers they are used to display the on, off or trigger status of the device.

Actuating units are deployed to allow actuation of the auxiliary contacts. In the case of contactors these are actuated for example with electromagnetic drives; in the case of power circuit breakers this is done for example with mechanical control units (latching mechanisms). Actuation of the mechanical control apparatus or electromagnetic drive brings about the closing or opening of the contacts, which are connected by way of the actuating units to the mechanical control unit or the electromagnet. Since there is now an increasing trend toward compact motor starter apparatuses for example—corresponding to one of the above-mentioned switching device combinations—auxiliary contacts of suitable form are required, as with known auxiliary contact blocks, in which for example external auxiliary contacts are built onto the switching device on different planes, the wiring outlay and space requirements are significant.

Auxiliary contact blocks for expanding a switching device with auxiliary contacts disposed in a plane with contact bridges and associated fixed contact pieces as well as with at least one contact slider, which can be equipped with at least one auxiliary contact pair, it being possible to actuate the contact slider by way of an actuating unit, which can be connected to at least one switching apparatus for switching the at least one switching point are known from DE 196 36 109 C1, WO 2005/101444 A, DE 101 18919 A1 and from DE 875 681 B. Further contact apparatuses are also known from DE 22 19 428 C2, DE 102 96 272 T5 and from DE 10 2004 034 859 A1.

SUMMARY

At least one embodiment of the invention specifies a compact auxiliary contact block, i.e. with little wiring outlay and a small space requirement, for a switching device and a switching device with at least one inventive auxiliary contact block.

At least one embodiment is directed to an auxiliary contact block for expanding a switching device with at least one conducting path and with at least one switching point, the auxiliary contact block having auxiliary contacts disposed in a plane with contact bridges and associated fixed contact pieces as well as at least one contact slider, which can be equipped with at least one auxiliary contact pair, it being possible to actuate the contact slider by way of an actuating unit, which can be connected to at least one switching apparatus for switching the at least one switching point, when the plane, in which the auxiliary contacts are disposed, is provided in a perpendicular arrangement to a direction of actuation of the at least one switching point.

Alternatively it is possible to provide elastic lines, about which the fixed contact pieces are bent, essentially perpendicular to a fixing plane, with which the switching device can be fixed in particular to a top-hat rail. These (virtual) elastic lines can be seen to some degree as axes of cylinders, about which the fixed contact pieces are bent during the bending process. The essentially perpendicular arrangement of the elastic lines to the fixing plane, with which the switching device can be fixed in particular to a top-hat rail, means that the fixed contact pieces only have bends parallel to the fixing plane, with the result that the ends of the fixed contact pieces on the output side are essentially perpendicular to the fixing plane of the switching device.

At least one embodiment is directed to a switching device with at least one conducting path, with at least one switching point, with at least one switching apparatus for switching the at least one switching point, with at least one auxiliary contact block and with an actuating unit for actuating the contact slider.

The structure of the auxiliary contacts in a plane, as described here, allows the auxiliary contacts to have a very small unit volume and require very little wiring outlay in a simple manner. The actuating unit here can be embodied as a slider for example, which couples the contact slider and the switching apparatus to one another.

In one advantageous embodiment at least one contact slider has two auxiliary make contacts, which can be coupled by way of the contact slider and the associated actuating unit to the switching apparatus, the switching apparatus being embodied as a mechanical control unit. The auxiliary contacts can thus communicate for example the status of a latching mechanism, i.e. of the mechanical control unit.

In a further advantageous embodiment at least one contact slider has a break-make combination, which can be coupled by way of the contact slider and the associated actuating unit to the switching apparatus, the switching apparatus being embodied as an electromagnetic drive. The auxiliary contacts can thus communicate for example the status of a contactor function, i.e. of the electromagnetic drive.

In a further advantageous embodiment the fixed contact pieces are disposed in a mirrored manner in the plane. This allows part variance to be reduced, as identical fixed conducting paths can be used here.

In a further advantageous embodiment identical contact bridges are provided for all the auxiliary contacts, with the result that part variance can be reduced further.

In a further advantageous embodiment the fixed contact pieces are embodied on the output side such that at least one terminal block can be built on. The use of one or more suitable terminal blocks means that not every auxiliary contact has to be connected individually.

In a further advantageous embodiment the auxiliary contact block can be integrated in a magnet chamber of the switching device. Individual houses are thus not required for the auxiliary contact block or the individual auxiliary contacts, thereby reducing the space requirement further. Integration of the auxiliary contact block in the switching device here results in a particularly compact component.

In a further advantageous embodiment the plane, in which the auxiliary contacts are disposed, is formed by a wall in the magnet chamber. This facilitates the mounting of the auxiliary contact block in the magnet chamber of the switching device for example.

BRIEF DESCRIPTION OF THE DRAWINGS

The invention is described in more detail below with reference to the example embodiments illustrated in the figures, in which.

DETAILED DESCRIPTION OF THE EXAMPLE EMBODIMENTS

Figure 1:
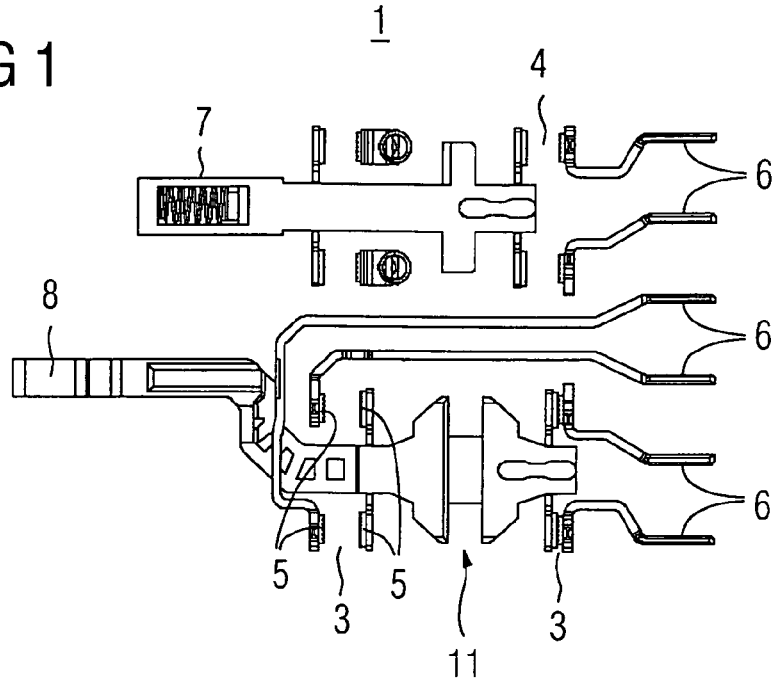
FIG. 1 shows a top view of an example embodiment of an inventive auxiliary contact block.

FIG. 1 shows a top view of an example embodiment of an inventive auxiliary contact block 1, which can be used for example for a motor or compact branch circuit. The contact sliders 7, 8 are equipped with the auxiliary contacts 3, 4 and lie parallel to one another in a plane. The associated fixed contact pieces 6 lie in the same plane as the auxiliary contacts 3, 4. The first contact slider 7 is formed by two make contacts, which are conceived as auxiliary contacts 4 for a mechanical control unit 9 (latching mechanism, see FIG. 3). The second slider 8 is a break-make combination 11 and serves for the contactor function of the compact branch circuit for example; in other words it is coupled by way of an actuating unit 15 to the electromagnetic drive 10 of the switching device 2 (see FIG. 3).

The auxiliary contacts 3, 4 here assume the above-mentioned functions such as communicating the status of the main contacts and/or displaying the on, off or trigger status of the device 2. The structure in a plane shown here allows the auxiliary contact block 1 to have a very small unit volume in a simple manner. The auxiliary make contact pair 4 and the break-make combination 11 do not require individual housings but can be integrated directly in the magnet chamber of the compact starter for example. Additional housing parts are therefore not required for auxiliary contact blocks 1.

Since the contact sliders 7, 8 are disposed in a mirrored manner in the plane, the part variance can also be reduced. Identical fixed conducting paths 6 can be used here, see also the two left-hand fixed contact pieces 6 with the two right-hand fixed contact pieces 6 in the diagram.

The bends in the fixed contact pieces 6 are therefore only in the plane in which the auxiliary contacts 3, 4 are disposed, i.e. the elastic lines, about which the fixed contact pieces are bent, are perpendicular to the plane. Identical contact bridges 5 are also provided for all the auxiliary contacts 3, 4, further reducing the required part variance. Since all the outputs of the auxiliary contacts 3, 4 are on one side, the wiring outlay for the auxiliary circuit breakers 3, 4 of the compact branch circuit for example is very small.

Figure 2:
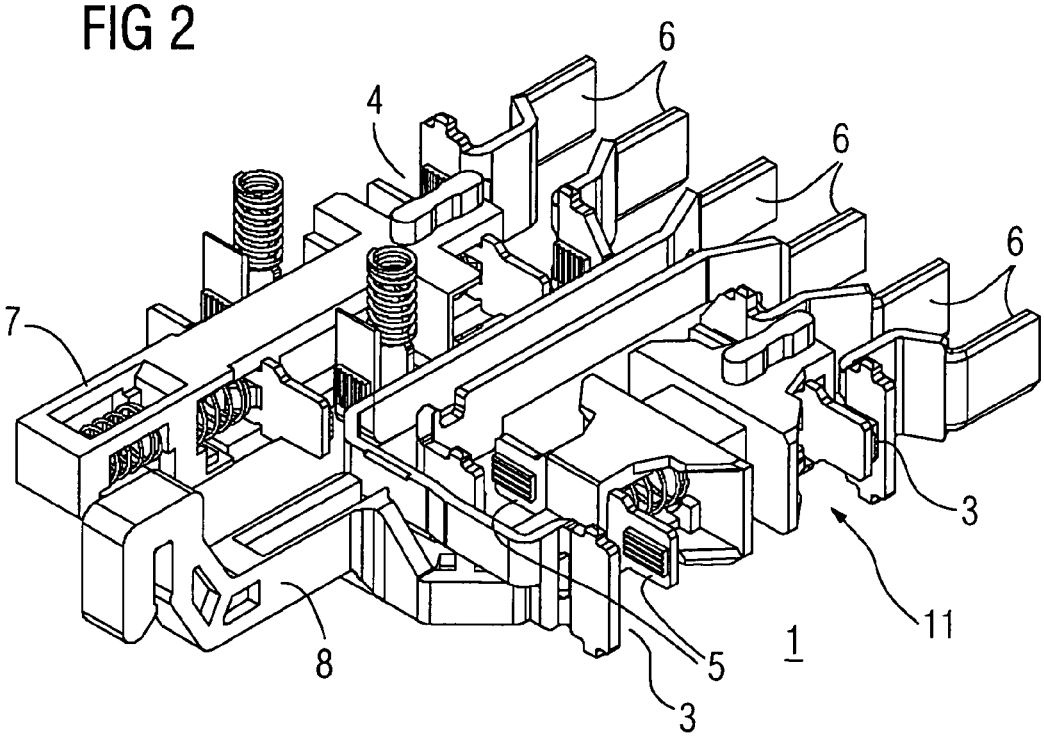
FIG. 2 shows a perspective view of the auxiliary contact block from FIG. 1.

FIG. 2 shows a perspective view of the auxiliary contact block 1 from FIG. 1. It clearly shows the arrangement of the contact sliders 7, 8 the auxiliary contacts 3, 4 and the associated fixed contact pieces 6 in a plane. See the description relating to FIG. 1 for details of the further reference characters.

Figure 3:
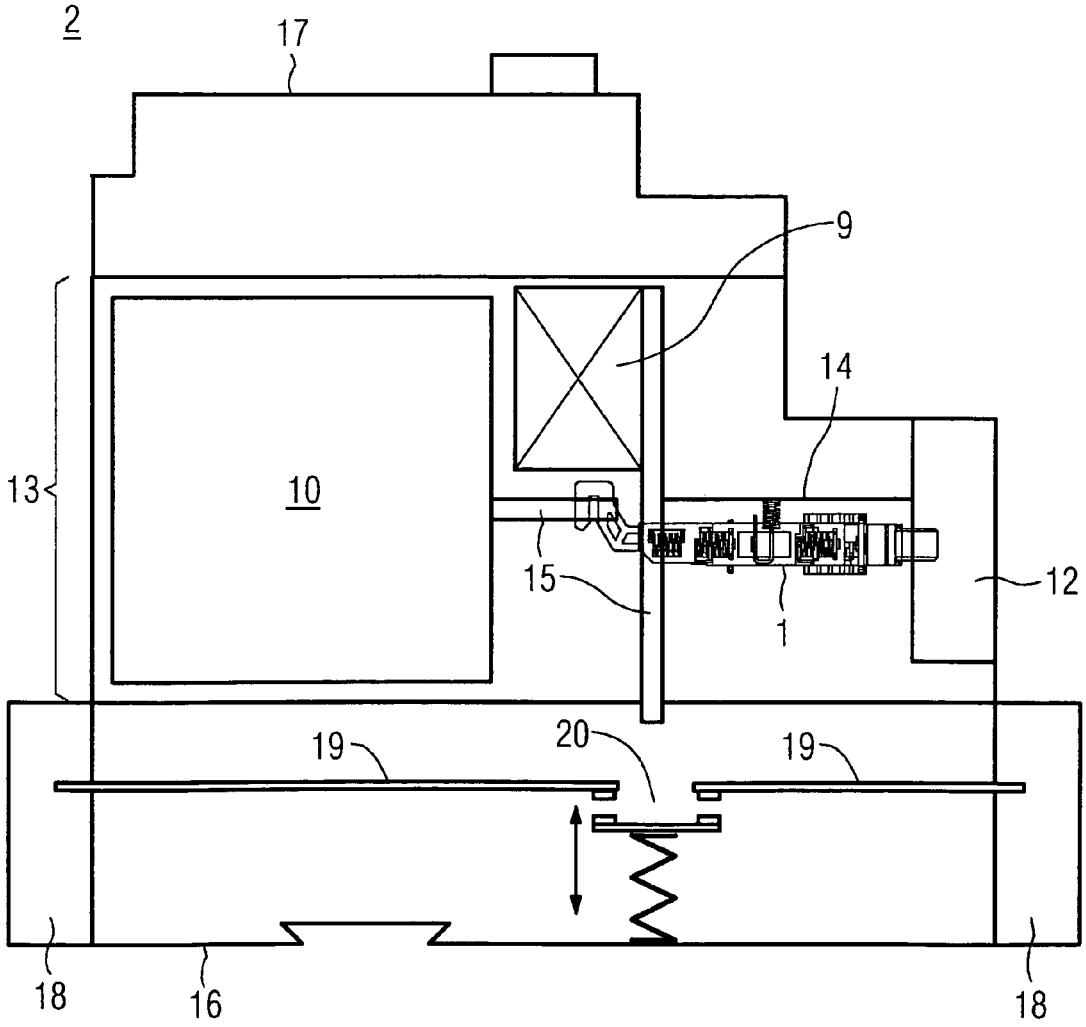
FIG. 3 shows a schematic diagram of a switching device with the auxiliary contact block from FIGS. 1 and 2.

FIG. 3 shows a schematic diagram of an example embodiment of a switching device 2 with auxiliary contact block 1 according to the invention. The switching device 2 has a lower part 16, a magnet chamber 13 and a cover 17. The lower part 16 has at least one (main) conducting path 19 and at least one switching point 20. The switching point 20 is embodied as a movable main contact, whose direction of movement is shown by the double arrow in the figure.

A terminal block 18 for the main conducting path 19 is affixed respectively to the left and right of the lower part 16. In the magnet chamber 13 are the electromagnetic drive 10, the mechanical control unit 9 (latching mechanism) and the auxiliary contact block 1. The contact sliders 7, 8 of the auxiliary contact block 1 are actuated by the switching apparatuses 9, 10 by way of actuating units 15. The first contact slider 7 of the auxiliary contact block 1 is coupled here to the mechanical control unit 9 and the second contact slider 8 is coupled to the electromagnetic drive 10. The actuating units 15 can be embodied as sliders. The auxiliary contact block 1 is integrated in the magnet chamber 13 and fixed to a wall in the magnet chamber 14, which thus forms the plane, in which the auxiliary contacts 3, 4 lie. This plane extends perpendicular to the direction of actuation of the at least one main contact 20. The fixed contact pieces 6 of the auxiliary contact block 1 are drawn outward on the output side such that an individual or a number of suitable terminal blocks 12 can be built on.

To summarize, at least one embodiment of the invention relates to an auxiliary contact block for expanding a switching device and a switching device with at least one inventive auxiliary contact block. At least one embodiment of the invention specifies a compact auxiliary contact block, i.e. with little wiring outlay and a small space requirement, for a switching device and a switching device with at least one inventive auxiliary contact block. At least one embodiment is directed to an auxiliary contact block, the auxiliary contact block having auxiliary contacts disposed in a plane with contact bridges and associated fixed contact pieces as well as at least one contact slider, which can be equipped with at least one auxiliary contact pair. The structure of the auxiliary contacts in a plane, as described here, allows the auxiliary contacts to have a very small unit volume and require very little wiring outlay in a simple manner. The actuating unit here can be embodied as a slider for example, which couples the contact slider and the switching apparatus to one another.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

The invention claimed is:

1. An auxiliary contact block for expanding a switching device with at least one conducting path and with at least one switching point, the auxiliary contact block comprising:

auxiliary contacts disposed in a plane with contact bridges and associated fixed contact pieces, at least one contact slider, equippable with at least one auxiliary contact pair, the at least one contact slider being actuatable via an actuating unit, the actuating unit being connectable to at least one switching apparatus for switching the at least one switching point, wherein the plane, in which the auxiliary contacts are disposed, is provided in a perpendicular arrangement to a direction of actuation of the at least one switching point.

2. The auxiliary contact block as claimed in claim 1, wherein at least one contact slider has two auxiliary make contacts which are coupleable by way of the contact slider and the associated actuating unit to the switching apparatus, the switching apparatus being embodied as a mechanical control unit.

3. The auxiliary contact block as claimed in claim 1, wherein at least one contact slider has a break-make combination, coupleable by way of the contact slider and the associated actuating unit to the switching apparatus, the switching apparatus being embodied as an electromagnetic drive.

4. The auxiliary contact block as claimed in claim 1, wherein the fixed contact pieces are disposed in a mirrored manner in the plane.

5. The auxiliary contact block as claimed in claim 1, wherein identical contact bridges are provided for all the auxiliary contacts.

6. The auxiliary contact block as claimed in claim 1, wherein the fixed contact pieces are embodied on the output side such that at least one terminal block can be built on.

7. The auxiliary contact block as claimed in claim 1, wherein the auxiliary contact block is integrateable in a magnet chamber of the switching device.

8. The auxiliary contact block as claimed in claim 7, wherein the plane, in which the auxiliary contacts are disposed, is formed by a wall in the magnet chamber.

9. A switching device including at least one conducting path, including at least one switching point, including at least one switching apparatus for switching the at least one switching point, including at least one auxiliary contact block as claimed in claim 1 and including an actuating unit for actuating the contact slider.

10. The switching device as claimed in claim 9, wherein the switching device is embodied as an electromechanical switching device or as a switching device combination.

11. An auxiliary contact block for expanding a switching device with at least one conducting path and with at least one switching point, the auxiliary contact block comprising:

auxiliary contacts disposed in a plane with contact bridges and associated fixed contact pieces;

at least one contact slider, equippable with at least one auxiliary contact pair, the contact slider being actuatable via an actuating unit, the actuating unit being connectable to at least one switching apparatus for switching the at least one switching point, wherein elastic lines, about which the fixed contact pieces are bent, are provided essentially perpendicular to a fixing plane, with which the switching device is fixable to a top-hat rail.

12. The auxiliary contact block as claimed in claim 11, wherein at least one contact slider has two auxiliary make contacts which are coupleable by way of the contact slider and the associated actuating unit to the switching apparatus, the switching apparatus being embodied as a mechanical control unit.

13. The auxiliary contact block as claimed in claim 11, wherein at least one contact slider has a break-make combination, coupleable by way of the contact slider and the associated actuating unit to the switching apparatus, the switching apparatus being embodied as an electromagnetic drive.

14. The auxiliary contact block as claimed in claim 11, wherein the fixed contact pieces are disposed in a mirrored manner in the plane.

15. The auxiliary contact block as claimed in claim 11, wherein identical contact bridges are provided for all the auxiliary contacts.

16. The auxiliary contact block as claimed in claim 11, wherein the fixed contact pieces are embodied on the output side such that at least one terminal block can be built on.

17. The auxiliary contact block as claimed in claim 11, wherein the auxiliary contact block is integrateable in a magnet chamber of the switching device.

18. A switching device including at least one conducting path, including at least one switching point, including at least one switching apparatus for switching the at least one switching point, including at least one auxiliary contact block as claimed in claim 11 and including an actuating unit for actuating the contact slider.

19. The switching device as claimed in claim 18, wherein the switching device is embodied as an electromechanical switching device or as a switching device combination.

* * * * *